US005271209A

United States Patent [19]

Boyhan

[11] Patent Number: 5,271,209

[45] Date of Patent: Dec. 21, 1993

[54] PACKAGING PROCESS AND APPARATUS

[75] Inventor: Laurence A. Boyhan, Melbourne, Australia

[73] Assignee: Gradual Pty. Ltd., Melbourne, Australia

[21] Appl. No.: 946,347

[22] PCT Filed: May 10, 1991

[86] PCT No.: PCT/AU91/00196

§ 371 Date: Nov. 5, 1992

§ 102(e) Date: Nov. 5, 1992

[87] PCT Pub. No.: WO91/17920

PCT Pub. Date: Nov. 28, 1991

[51] Int. Cl.[5] ..... B65B 5/08; B65B 35/32

[52] U.S. Cl. ..... 53/473; 53/158; 53/243; 53/539

[58] Field of Search ..... 53/473, 539, 243, 158, 53/247

[56] References Cited

U.S. PATENT DOCUMENTS

| | | | |
|---|---|---|---|
| 3,545,164 | 12/1970 | Middleton | 53/539 X |
| 3,791,099 | 2/1974 | Wagner | 53/243 X |
| 4,026,091 | 5/1977 | Pearson | 53/539 X |
| 4,403,462 | 9/1983 | Halbich | 53/539 X |
| 4,693,057 | 9/1987 | Rittinger et al. | 53/539 |

*Primary Examiner*—James F. Coan

*Attorney, Agent, or Firm*—Charles Berman; Sarah B. Adriano

[57] ABSTRACT

Apparatus and process in which one plate, or several accurately superimposed plates carry items to be packaged. On inversion of the plates, items either fall directly into the voids of a partitioned box or fall into individual packages held by a plate, which packaged items are then ejected by pushrods into a single box. A plate may have cut-away portions such as V-shaped grooves which receive upstanding edges or partition walls of a box to accurately register the box with the plate and contents and nest the box into the plate to achieve configuration-accurate inversion of the items to be packaged.

11 Claims, 3 Drawing Sheets

Figure 3:
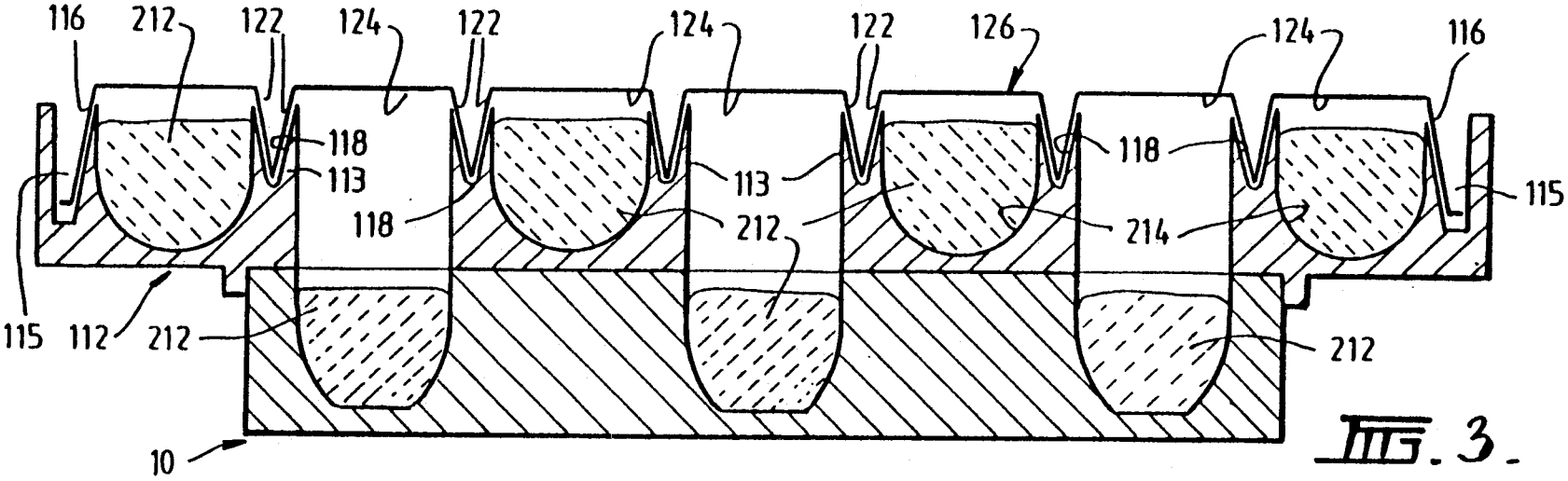

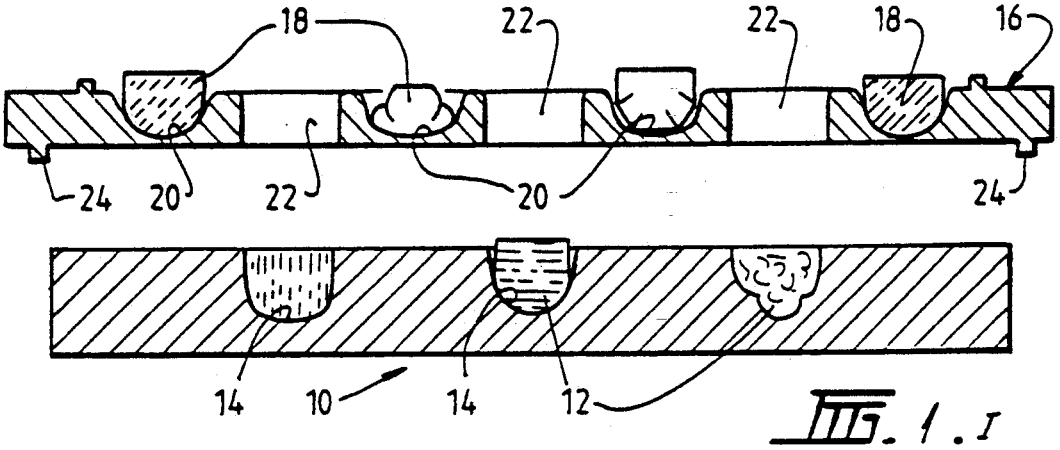
FIG. 1. I
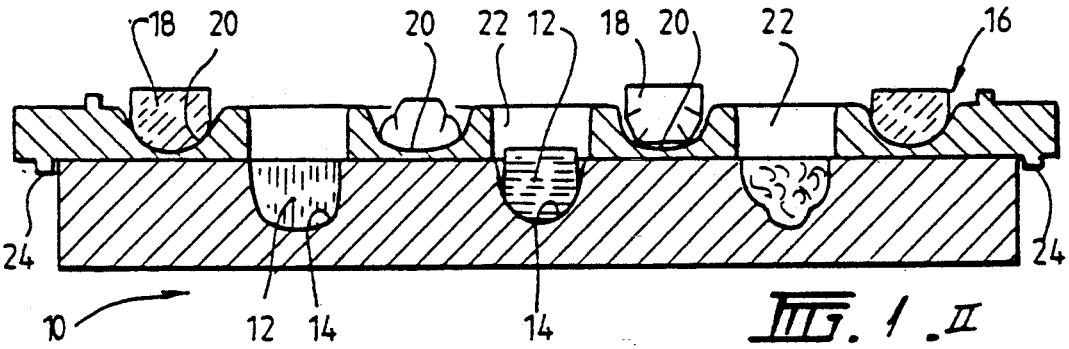
FIG. 1. II
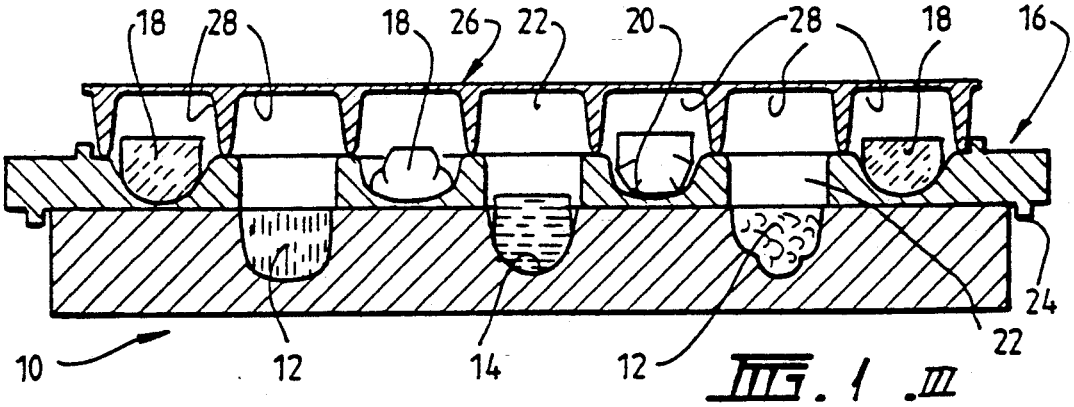
FIG. 1. III
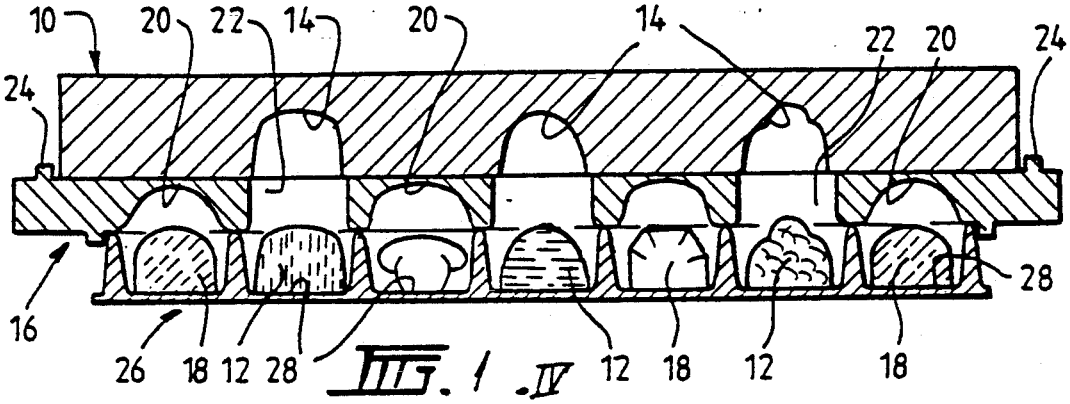
FIG. 1. IV

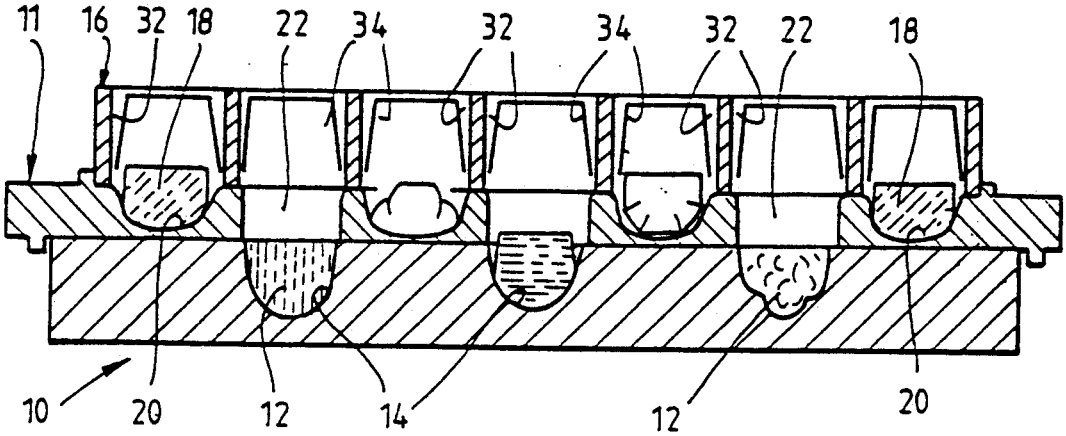
FIG. 2. III
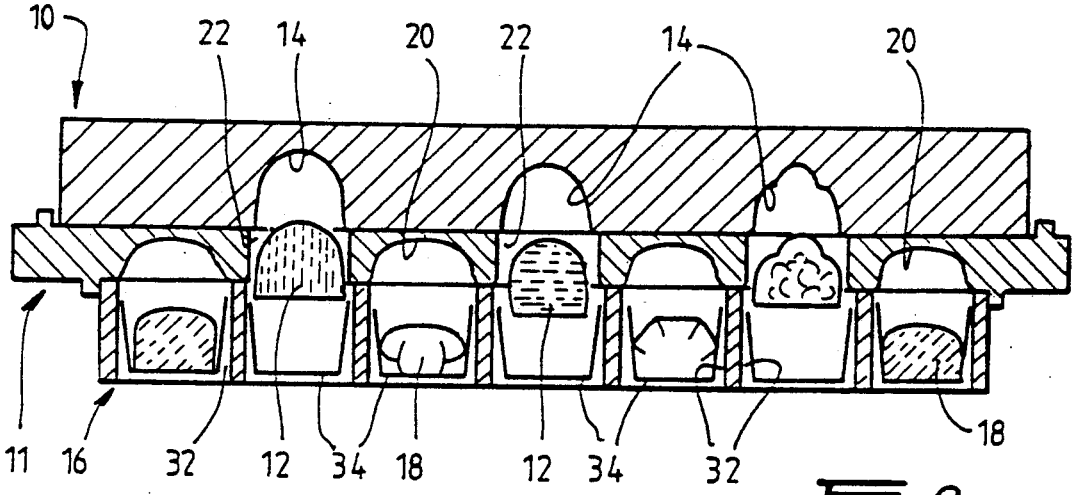
FIG. 2. IV
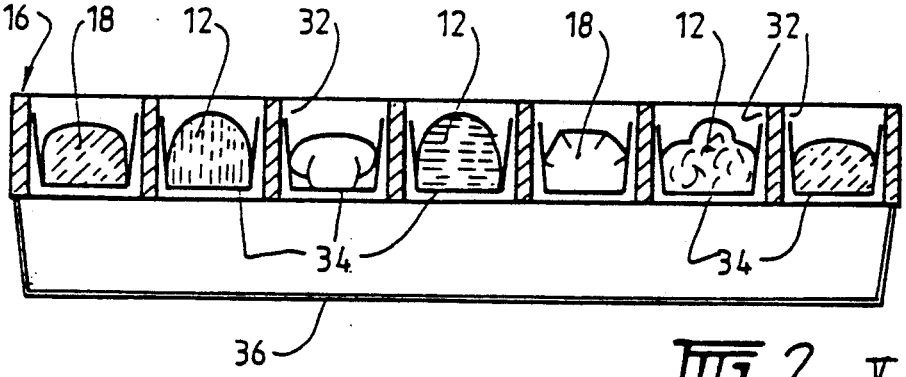
FIG. 2. V

PACKAGING PROCESS AND APPARATUS

This invention relates, in general terms, to apparatus for the packaging of articles. The invention also relates to a process for the packaging of articles. Primarily, the invention is concerned with multi-article packages, that is to say packages which contain more than one article, and to apparatus and a process for the packaging of such articles. In one embodiment the invention relates to the packaging of a plurality of different types of product in a single package.

In the packaging art it is convenient to consider the existence of two basic types of packaged product. These are, firstly, where all the articles to be packaged are of the one type and, secondly, where the articles to be packaged are of two or more different types.

One of the problem areas which exist in relation to both basic types of packaged product, is in relation to the accurate positioning of a package to receive the product. A further difficulty concerns the question of the orientation of an article when it is packaged. Certain articles need to be packaged with reference to a specific orientation of the article within the package. In particular, some articles have a distinct bottom surface, and the article must be packed so that the bottom surface sits on the bottom of the package.

It is accordingly, a first object of the present invention, to provide a packaging apparatus and a packaging process which addresses, and at least partly overcomes, the problems and difficulties which exist at the present time in relation to the packaging or location of articles of different types into a one or more packages or containers.

It is a second object of this invention to provide a packaging apparatus and a packaging process which address, and at least partly overcomes, the problems and difficulties which exist at the present time in relation to the accurate positioning of a package to receive product, and, to the orientation of a packed article.

In accordance with one aspect of the present invention there is provided an apparatus for packaging products, said apparatus including; a first plate member having a plurality of cavities adapted to receive product to be packaged; a second plate member having a plurality of apertures extending therethrough equal in number to the number of cavities in said first plate member; means to move said first plate member into contact with said second plate member so that said second plate member overlies said first plate member, with the openings of said cavities facing upwardly, and, with said apertures in said second plate member overlying the cavities carrying said product; means to register a package or container means against said second plate member; and, means to invert said package or container means, with said two plate members being in overlying relationship, so that said products move into said package or container means in predetermined positions determined by the position of said cavities.

In accordance with another aspect of the invention a number of apertures in the second plate member are formed as cavities to receive a second product.

As will be appreciated by those skilled in the Art, the number of plate members which may be used in the invention to bring together product from different sources need only be limited by the size of the plates and the number of product pieces which are to be packed. Thus three or four plate member could be used quite successfully. What is required with each successive plate, which overlies the plate or plates below, is that apertures must be provided in alignment with the cavities on the plate or plates below so that upon inversion of the plates and package, access is provided for product to pass through the successive plates into the package.

The package will always be registered with the uppermost plate, before inversion of the assembly.

In yet another aspect the invention provides an apparatus for the packaging of products wherein each product piece is to be individually packaged by the apparatus before being packed together in the one outer package. In this aspect the second plate member retains and positions a number of individual product packages, which correspond to the number of products carried by the plate member. After the two plate members are brought into contact in overlying relationship there is inversion of the first and second plate members whereby the products move into the individual product packages, which remain held by said second plate member. The second plate member is then registered against the outer package in an overlying relationship and means are provided to transfer the individually packaged products into the outer package by passing them through the second plate member, whereby to complete the packaging operation.

In one preferred embodiment of the invention and with reference to the foregoing, the first product is formed, as for example by moulding of the first product, in at least some of the cavities of said first plate member. In this embodiment the apparatus may need to be provided with means to cause the first product to release from the cavities in the first plate member at the time that the first products are to move into a package. That is, upon inversion of the first plate member.

In a further preferred embodiment of the invention the first and second plate members may be formed as an integral, single plate. This embodiment is relevant, for example, when product is not sourced from two different areas. Thus, a single plate may be loaded with product of one, or more than one type, and a package registered against means provided on the plate, said means being the same or similar to those provided on the second plate member of the preceding embodiments, before inversion to transfer the product to a package.

In yet another embodiment of the invention the package which is registered against the second plate member may be a plurality of packages grouped together.

In one specific and particularly preferred embodiment of the invention there is provided an apparatus and method for packaging a first type of confectionery product and a second different type of confectionery product in a package having preformed voids designed to receive the two types of product in predetermined locations within the package. It is also envisaged that some or all of the first and/or the second type of confectionery product may be individually pre-packaged in, for example, foil.

The invention is particularly suitable where the packages have a plurality of pre-formed voids therein, designed to receive the respective products.

Where such packages are used the invention provides a unique and effective registration procedure which in its preferred embodiment effectively registers each void of the package to a cavity of the, or each, plate which carries product.

Accordingly there is provided locating means for the package on the second plate member in the form of a cut-away portion at the edge of the second plate member into which the peripheral edge of the package can be received. In one form that cut-away portion may take the form of a peripheral recess. When that occurs, the effect is to restrain lateral movement of the package with respect to the second plate member.

In a preferred embodiment, additional locating means are provided on the second plate member, constituted by the top of at least part of the internal wall of the second plate member being cut-away to allow the top edge of the walls of the package to be received in that cut-away section. In one form the cut-away section is formed as a groove in the top of the walls of the second plate member, which are those which define the apertures and, if present, cavities therein.

As it is important that the two plate members move into and remain in a specific overlying relationship, once brought into contact, it is preferred that means are provided on one or both of said plate members for location of the two members in the desired overlying relationship, said means may also assist in retaining the two plate members in that relationship until such time as the products carried in the cavities thereof have been delivered to the package. These means include guide means on one or both of said plate members serving to guide and retain the two plate members to and in the correct juxtaposition, however, as will be appreciated by those skilled in the art, numerous arrangements could be employed to achieve these aims, and any suitable means which achieve these objectives, is within the invention.

For ease of explanation throughout the following description, reference will be made to an especially preferred usage of the apparatus and process of the present invention, namely in the confectionery field for the packaging of different types of confectionery product in a single package. It should be understood, however, that such reference is merely exemplary and that the invention is not to be considered to be in any way limited to such usage. Indeed, the apparatus and process of the present invention will readily lend themselves to the packaging of a variety of other articles and products.

Figure 4:
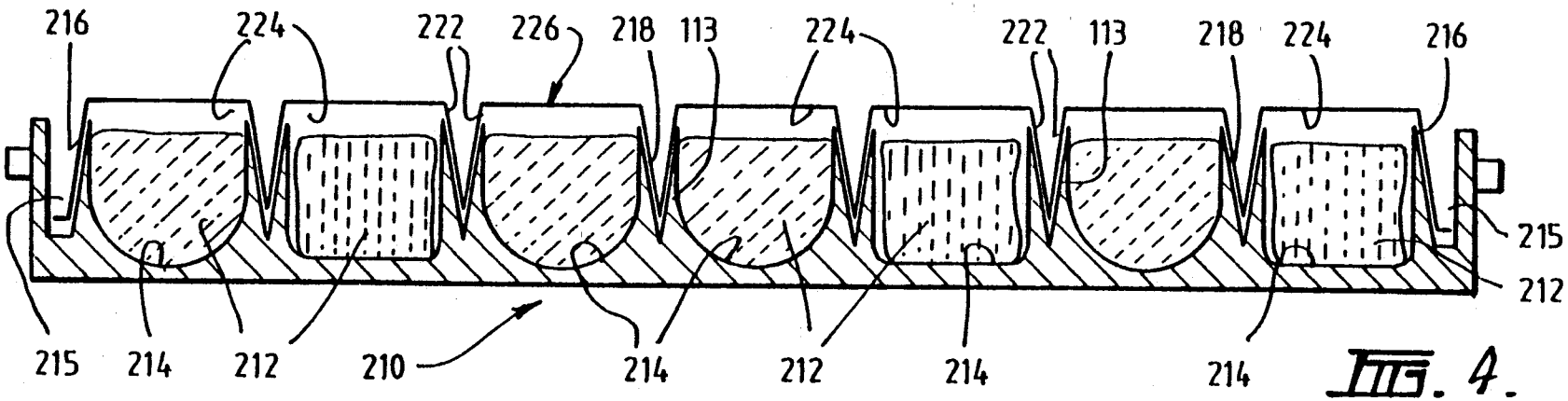

Reference will now be had to a particularly preferred apparatus and process, which is illustrated in the accompanying drawings, wherein:

FIGS. 1.I–1.IV are schematic drawings of cross-sectional side elevations of apparatus in accordance with the invention, in which the stages marked I, II, III and IV, are sequential steps in the process of the invention;

FIGS. 2.III–2.V are schematic drawings similar to FIG. 1, showing another embodiment of the invention;

FIG. 3 is a cross-sectional side elevation of a package and a second plate member showing in detail the preferred registration feature; and FIG. 4 is a cross-sectional side elevation of a package and a single plate member, in a further embodiment of the invention.

With reference to FIG. 1 of the drawings and stages I and II, there will be seen two plate members containing product, which are independently positioned, one to the other. There is a first plate member 10 containing a plurality of first products 12, located in cavities 14 and, a second plate member 16 containing a second product 18 in cavities 20. Each of plate members 10 and 16 carry up to 35 product pieces each.

Second plate member 18 also contains a plurality of apertures, or holes 22 extending therethrough and, has a plurality of locating means 24 associated therewith.

In the process of the invention, the plate members 10 and 16 are brought into contact as shown in stage II, with second plate member 16 overlying first plate member 10 which is located in relation to plate member 16, with the assistance of locating means 24, in such a way that holes 22 overlie cavities 14 of plate member 10.

Stage III illustrates the addition of a package or container 26 having a plurality of preformed voids 28 therein. Package 26 overlies plate member 16 so that voids 28 overlie cavities 14 and 20. This is achieved by any suitable means. The process of the invention then requires inversion of plate members 10 and 16 and package 26, as shown in FIG. IV, and, as will be appreciated, product 12 drops through holes 22, and product 18 drops directly into voids 28, under the effect of gravity, whereby to complete the packaging of package 26.

The package 26 is then handled in a conventional way, by the addition of a top or other closure and, other packaging ornamentation as deemed necessary or desired.

Referring now to FIG. 2, there is shown stages III, IV, and V of an alternate embodiment of the process and apparatus of the invention.

It is understood that stages I and II of this embodiment are the same as those of FIG. I.

In stage III there is seen a first plate member 10 and an intermediate plate member 11 which have been brought into overlying relationship. Product 12 and 18 are seen in cavities 14 and 20 respectively.

A second plate member 16 is provided to overlie plate member 11. Plate member 16 is provided with a plurality of apertures, or holes, 32 therethrough which correspond in number and position with each of cavities 20 and holes 22 of plate member 11.

In each hole 32 is provided with packaging 34 for each of product pieces 12 and 18.

Packaging 34 is in the form of fluted cups of paper or plastic which are inverted from their "in use" position and which are retained in holes 32 by retaining means therein (not shown).

In the process of the invention the three plate members 10, 11 and 16 are inverted, as a unit, as shown in stage IV. Under the effects of gravity, product 12 and 18 drops into packaging 34 but is retained within holes 32 of plate member 16. Plate members 10 and 11 are then removed from plate member 16.

As individually packaged product 12 and 18 is still to be packaged in an outer container of some kind, the process provides for such a container, in this case a flat cardboard package 36 to be positioned against and underneath second plate member 16, as seen in stage V.

Means is then provided to push packaging 34 and product 12 and 18 out of holes 32 and into package 36. These means are not shown, but can be as simple as a plurality of push rods which align with holes 32 and move downwardly to displace the contents of holes 32 into package 36.

Referring now to FIG. 3, there is shown therein a particularly preferred embodiment of an arrangement to obtain positive registration of a package 126 by a second plate member 112. The second plate member 112 is provided with a cut-away portion around its edge, in the form of a peripheral groove 115, into which is received an upstanding edge portion 116 of package 126. In addition to the capture of the periphery of package 126, the internal walls of plate member 112, which are shown at 113, are provided with cut-away portions in the form of grooves 118 to receive wall portions 122 of package 126; said wall portions 122 being walls which form the preformed voids 124 of package 126.

Referring now to FIG. 4 there is seen a single plate member 210 containing a plurality of cavities 214 carrying product 212. Overlying plate member 210 is a package 226 which is of the type having a plurality of preformed voids 224 separated by internal walls 222.

Plate member 210 is provided with a peripheral groove 215 which receives the peripheral edge 216 of package 226. The internal walls 113 of plate member 210 are provided with V-shaped grooves 218 which receive the internal walls 222 of package 226.

Upon inversion of plate member 210 and package 226 product 212 moves into voids 224. As the base of package 226 is close to product 212, there is little or no possibility that the orientation of product 212 will be other than a inversion of the configuration shown in FIG. 4, which is the specific orientation desired in the package.

Also, registration of each of cavities 214 with a void 224 is achieved to ensure that the location of each article to be packaged is as pre-determined.

As will be appreciated by those skilled in the art, packaging apparatus and packaging processes are most efficient when run continuously and the apparatus of this invention envisages that plate members 10, 11, 16 and 112 and 212 move on continuous belts, not only during stages I–IV of FIG. 1 and stages III to V of FIG. 2, but both before and after those stages. Such continuous track or belt does not constitute part of the present invention and description thereof is not provided, as it will be known and understood by those skilled in this art.

I claim:

1. Apparatus for packaging articles, comprising, a first plate member having a plurality of cavities adapted to receive articles to be packaged; a second plate member having a plurality of apertures extending therethrough equal in number to the number of cavities in said first plate member; means to move said first plate member into contact with said second plate member so that said second plate member overlies said first plate member, with the openings of said cavities facing upwardly, and, with said apertures in said second plate member overlying the cavities carrying said articles; means to register a package or container means against said second plate member; and, means to invert said package or container means, with said two plate members being in overlying relationship, so that said articles move into said package or container means in predetermined positions determined by the position of said cavities.

2. Apparatus as claimed in claim 1 wherein one or more apertures in said second plate member are formed as cavities and receive a second group of articles therein.

3. Apparatus as claimed in claim 1 wherein said second plate member is provided with packaging for each article, said packaging being retained within the apertures thereof.

4. Apparatus as claimed in any one of claims 1 to 3 wherein one or more intermediate plate members containing apertures and cavities are provided which also receive articles to be packaged in said cavities therein, said intermediate plate members being positioned between said first and second plate members prior to inversion thereof.

5. Apparatus as claimed in any one of claims 1 or 2 wherein said second plate member has a cut-away portion at its edges into which the peripheral edge of a package may be received.

6. Apparatus as claimed in claim 5 wherein said cut-away portions are formed as grooves.

7. Apparatus as claimed in claim 3 wherein said second plate member has a cut-away portion at its edges into which the peripheral edge of a package may be received.

8. A process for packaging articles comprising supporting said articles in cavities which are positioned in predetermined locations in a first plate member, registering a package and a second plate member containing a corresponding number of apertures to said cavities against said first plate member, inverting the two plate members and the package whil in registration to cause the articles to fall into said package, and, removing the two plate members.

9. A process as claimed in claim 8 wherein one or more apertures in said second plate member are formed as cavities which support articles therein.

10. A process as claimed in claim 8 or 9 wherein one or more intermediate plate members containing apertures and cavities to receive product are positioned between said first and second plate members prior to inversion thereof.

11. Apparatus for packaging articles, including a plate member having cavities adapted to carry articles, or, apertures to allow articles to pass therethrough, said plate member being adapted to register against at least one package and having cut-away portions in the internal walls between said cavities or apertures, said cut-away portions being of sufficient proportions to allow at least the top edge of one or more internal walls of said package or packages to be received therein.

* * * * *